US008156760B2

(12) United States Patent
Gad

(10) Patent No.: US 8,156,760 B2
(45) Date of Patent: Apr. 17, 2012

(54) GEMSTONE CUT

(75) Inventor: Morris Gad, Great Neck, NY (US)

(73) Assignee: Albert Gad, Ltd., Brooklyn, NY (US)

( * ) Notice: Subject to any disclaimer, the term of this patent is extended or adjusted under 35 U.S.C. 154(b) by 0 days.

(21) Appl. No.: 12/485,609

(22) Filed: Jun. 16, 2009

(65) Prior Publication Data

US 2009/0308104 A1 Dec. 17, 2009

Related U.S. Application Data

(60) Provisional application No. 61/061,727, filed on Jun. 16, 2008.

(51) Int. Cl.
*A44C 17/00* (2006.01)

(52) U.S. Cl. ..... 63/32

(58) Field of Classification Search ..... 63/32; D11/90
See application file for complete search history.

(56) References Cited

U.S. PATENT DOCUMENTS

| | | | | |
|---|---|---|---|---|
| 2,364,031 | A | | 11/1944 | Suderov |
| 3,286,486 | A | | 11/1966 | Huisman et al. |
| 3,585,764 | A | | 6/1971 | Huisman |
| 3,763,665 | A | | 10/1973 | Polakiewicz |
| 3,788,097 | A | | 1/1974 | Elbe |
| D316,984 | S | | 5/1991 | Cohen |
| D337,544 | S | * | 7/1993 | Cohen ..... D11/90 |
| D382,506 | S | | 8/1997 | Cohen |
| D439,864 | S | | 4/2001 | Cohen |
| D447,082 | S | | 8/2001 | Cohen |
| 6,397,832 | B1 | | 6/2002 | Shuto |
| D460,711 | S | * | 7/2002 | Cohen ..... D11/90 |
| D466,436 | S | * | 12/2002 | Tolkowsky ..... D11/90 |
| D491,093 | S | | 6/2004 | Mehta |
| 6,761,044 | B2 | | 7/2004 | Samuels |
| D503,354 | S | | 3/2005 | So |
| D555,032 | S | | 11/2007 | So |
| D577,625 | S | * | 9/2008 | Shah ..... D11/90 |
| 2005/0011226 | A1 | | 1/2005 | So |
| 2006/0026991 | A1 | | 2/2006 | Shuto |
| 2009/0038341 | A1 | | 2/2009 | Zheng |
| 2009/0056374 | A1 | | 3/2009 | Abate |

FOREIGN PATENT DOCUMENTS

| | | |
|---|---|---|
| JP | 2003210221 | 7/2003 |

* cited by examiner

*Primary Examiner* — Jack W. Lavinder
(74) *Attorney, Agent, or Firm* — Ostrolenk Faber LLP

(57) ABSTRACT

A novel gemstone cut that has 162 facets such that the crown has 65 separate facets and the pavilion has 97 separate facets.

5 Claims, 5 Drawing Sheets

SECTION J-J OF FIG.1

SECTION K-K OF FIG.1

GEMSTONE CUT

INDEX TO RELATED APPLICATIONS

This application claims benefit of U.S. Provisional Patent Application No. 61/061,727, filed Jun. 16, 2008 the disclosure of which is incorporated herein by reference in its entirety.

BACKGROUND OF THE INVENTION

Gemstones are generally cut with facets forming the exterior surface of the stone. The surfaces of the facets are then polished to obtain the brilliance, dispersion and/or scintillation desired from the gem. Facets cut in a gemstone may also form a geometric figure or design. The prior art is replete with teachings making gems from gemstones by cutting facets in the surface of the stone and then polishing the surface of the facet to obtain the brilliance and scintillation desired, when the gem is exposed to light. Facets are usually cut in the crown and in the pavilion of the stone.

The present invention provides a gemstone that comprises a gemstone having 162 facets. Many commercially available diamonds typically have about 58 facets. The increased number of facets of the gemstone of the present invention produces a cut stone that is more desirable.

BRIEF SUMMARY OF THE INVENTION

The present invention is a novel gemstone cut that has 162 facets. The facets are constructed and arranged such that the crown has 65 separate facets and the pavilion has 97 separate facets.

DETAILED DESCRIPTION OF THE PREFERRED EMBODIMENTS

Figure 1:
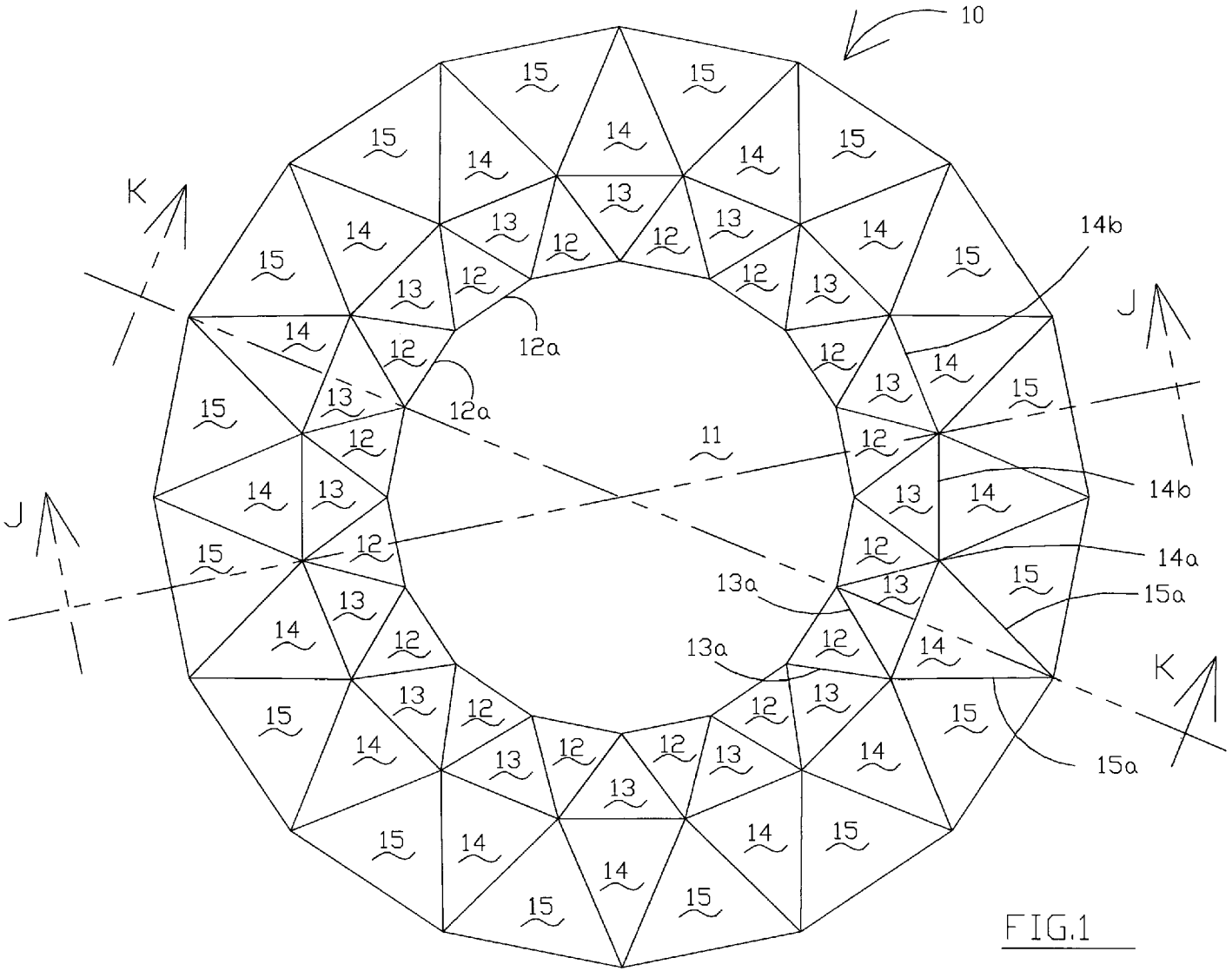
FIG. 1 is a top view of the gemstone.

The gemstone of the present invention is preferably a diamond. In a preferred embodiment, the following are preferred embodiments of the configurations of the gemstone:

| | |
|---|---|
| Girdle: | 2.0% to 5.5% |
| Table: | 54% to 62% |
| Crown Angle 1: | 34° to 36° |
| Crown Angle 2: | 30° to 32° |
| Crown Height: | 13.5% to 16% |
| Pavilion Angle: | 40.5° to 41.5° |
| Pavilion Mains 1: | 43% to 44.5% |
| Total Height: | 58% to 66% |

The angles and percentages are expressed as is commonly done in gemology. The Gemstone 10 has table 11 on its uppermost surface. Circumferraly surrounding the table are an interlocking triangular arrangement of alternating star facets 12 and first crown facets 13. Circumferraly surrounding the first crown facet cuts 13 are a second triangular arrangement of alternating second crown facets 14 and upper half facets 15. The lower portion of gemstone 10 is a pavilion 23 having a series of circumferral triangular first lower half cut facets 16. Adjoining each first lower half cut facets 16 are kite shaped first pavilion main cut facets 17 which are adjacent to triangular pairs of second lower half cut facets 18. Adjoining each of said second lower half cut facets 18 are substantially rhomboidal second pavilion main cut facets 19 that surround a culet 20.

The lower portion of gemstone 10 is a pavilion 23 having a series of circumferral triangular first lower half cut facets 16. Adjoining each first lower half cut facets 16 are kite shaped first pavilion main cut facets 17 which are adjacent to triangular pairs of second lower half cut facets 18. Adjoining each of said second lower half cut facets 18 are substantially rhomboidal second pavilion main cut facets 19 that surround a cutlet 20.

The table 11 is a 16-sided polygon, sometimes also called a hexadecagon. In a preferred embodiment, table 11 is a substantially regular hexadecagon. A regular hexadecagon has equal sides. The hexadecagon configuration of table 11 of the present invention is formed by arrangement of star facets 12 such that each star facets 12 has a single edge 12*a* successively positioned around table 11 such that single edge 12*a* defines a portion of the perimeter of hexadecagon table 11. Each single edge 12*a* of star facets 12 defines a portion of the perimeter of table 11 and is approximately equal in length to each of the other single edge 12*a* sides of each said star facets 12.

Each of star facets 12, first crown facets 13, second crown facets 14 and upper half facets 15 are triangular. They are preferably each substantially isosceles triangles. In one embodiment, they may be a combination of isosceles and equilateral triangles. Isosceles triangles, as is known, have two equal sides. Equilateral triangles, as is known, have three equal sides.

First lower half cut facets 16 are triangular and are arranged such that each first lower half cut facets 16 shares one side 16*a* with an adjacent first lower half cut facets 16 and each lower half cut facets 16 shares one point 16*b* with an adjacent first lower half cut facets 16.

Each first pavilion main cut facets 17 is a kite shaped facet.

A kite configuration, as is known in the art and shown by the diagram below, is a planar convex quadrilateral consisting of two adjacent sides of length a and the other two sides of length b. A rhombus configuration is a special type of kite.

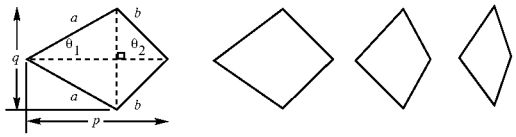

A kite is shown above. The area of a this kite is given by $$A = \frac{1}{2}pq,$$

where p and q are the lengths of the polygon diagonals, which are perpendicular.

Figure 2:
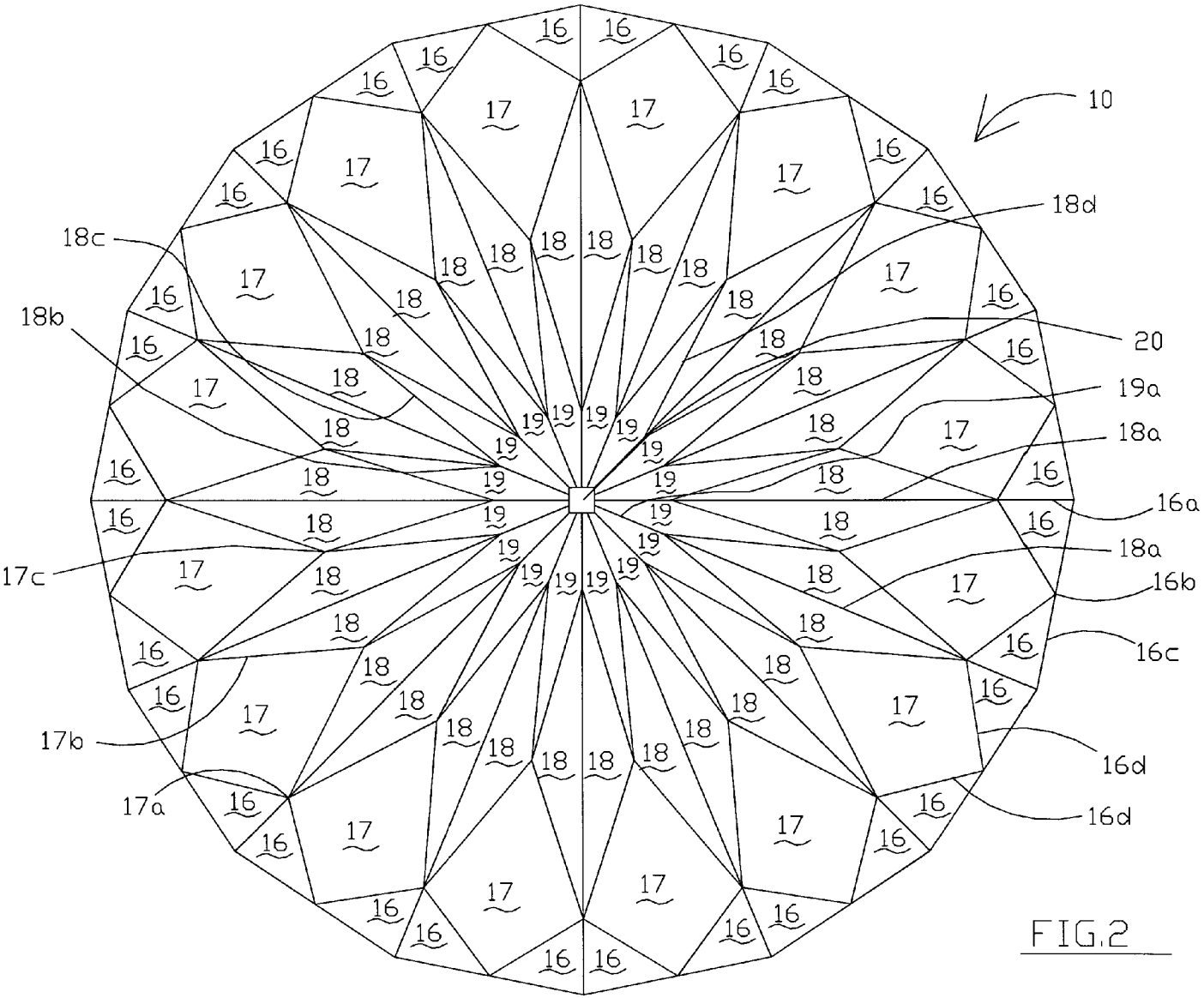
FIG. 2 is a bottom view of the gemstone.

Each of second lower half cut facets 18 are triangular and said second lower half cut facets 18 are arranged in pairs, as seen in FIG. 2, such that each pair of second lower half cut facets 18 share an adjacent side 18*a* which is the longest side of the triangle shaped second lower half cut facets 18. Each arranged pair of second lower half cut facets 18 forms a substantially rhomboidal configuration.

Figure 3:
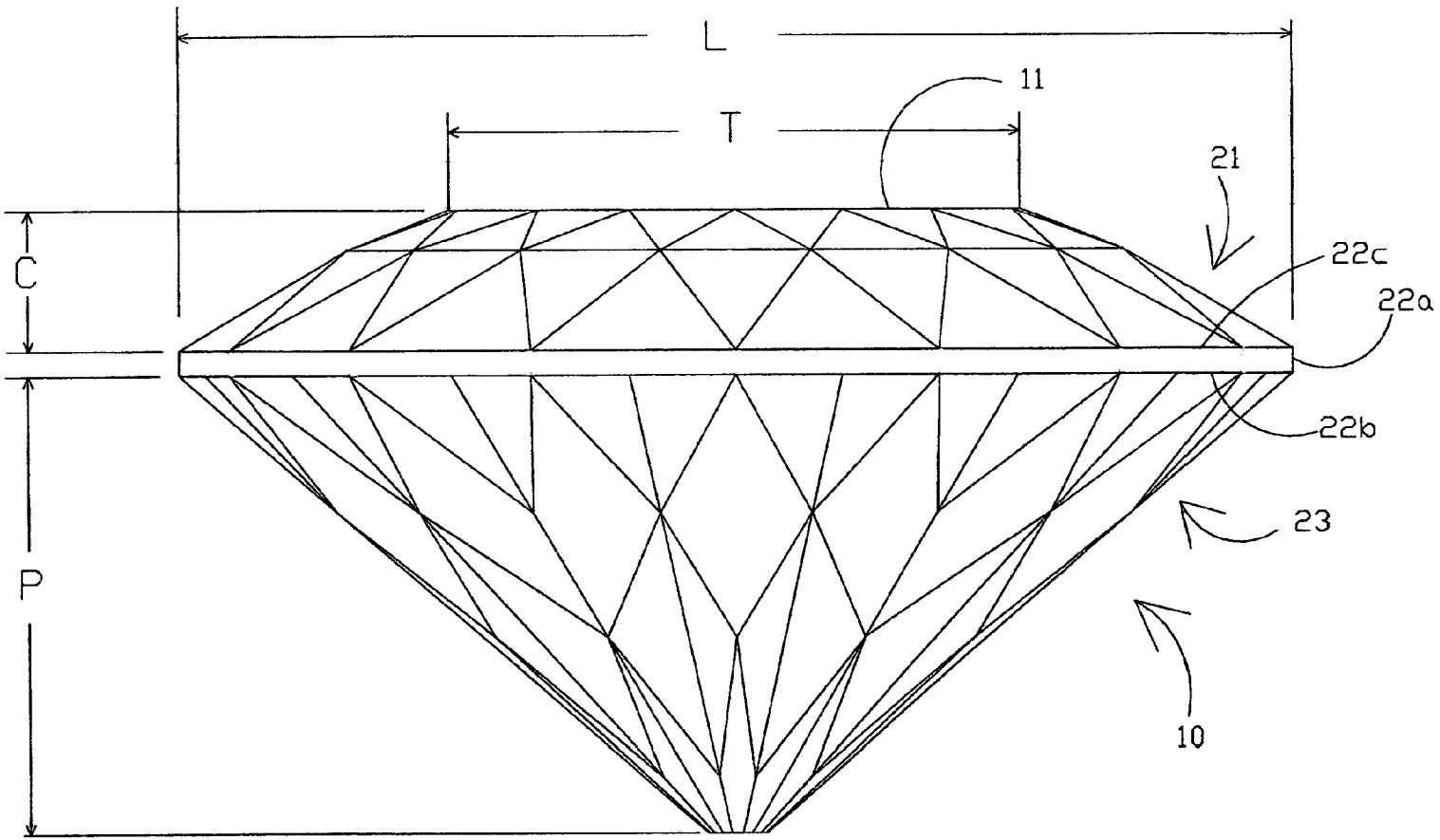
FIG. 3 is a side view of the gemstone, where girdle 22*a* is shown enlarged and not in proportion to crown 21 and pavilion 23.

As shown in FIG. 3, the gemstone 10 has a crown 21 that is the upper portion of gemstone 10 above a circumferal girdle 22*a*. Below girdle 22*a* is a pavilion 23. Table 11 has a diameter T. Gemstone 10 has an overall diameter L defined by opposing edges of girdle 22*a*. Each of table 11 diameter T and overall diameter L are along line K-K from FIG. 1. Crown 21 has a height C. Pavilion 23 has a height P. The dimensions of gemstone 10 in regards to any of diameter T, diameter L, height C, and height P can vary to accommodate 162 facets as contemplated in the present invention.

Facet Configurations

FIG. 1 is a top view of gemstone 10. Gemstone 10 can be any suitable dimension, size, or weight.

Gemstone 10 generally includes a crown 21 and a pavilion 23. Crown 21 includes the top or upper portion of gemstone 10, while pavilion 23 includes the bottom or lower portion of gemstone 10. In a preferred embodiment, a girdle 22*a* is located between crown 21 and pavilion 23. Both crown 21 and pavilion 23 include a plurality of flat facet surfaces as described in detail below.

Facets described herein can be substantially or generally flat. Facets can also be formed into various geometric shapes. These shapes can be described using precise terms although the actual form of the shape may vary. For example, a triangular facet can include a substantially or generally triangular shape including three sides. The triangular facet may include straight or arcuate sides. Further, the combined summation of angles of the three vertices could be about 180°, such as, for example, 160° or 200°. Similar variations could occur with other parameters of the triangular facet, or any other facet geometry described herein. These and other geometries, angles, configurations, or arrangements of facets described herein are general descriptions and not precise mathematical definitions. For example, angles described herein can include a range of variation, such as, for example, +/−¼°, +/−½°, +/−1°, or +/−2°, depending upon material properties, such as the refractive index. Also, the term radially can include arrangements that are generally or approximately radial in distribution.

FIG. 1 is a top view of gemstone 10, showing crown 21. As shown in FIG. 1, crown 21 includes a table facet 11 and various facets 12, 13, 14, and 15 arranged in a substantially symmetrical pattern around the perimeter of table facet 11 and encompassing the surface perimeter of crown 21. Crown 21 includes four sets of generally symmetrical facets 12, 13, 14, and 15. Star facets 12 and first crown facets 13 are circumferal about the perimeter of table 11. Table 11 is defined by successive edge portions 12*a* of star facet 12 disposed about the perimeter of table 11 wherein the perimeter of table 11 is defined by single edge 12*a*. In a preferred embodiment, there are sixteen (16) separate star facets 12 about table 11 and star facets 12 are arranged such that single edge 12*a* of star facets 12 are successively placed and the entire perimeter of table 11 is defined by the sum of all successive single edge 12*a*.

As shown in FIG. 1, each star facet 12 is in contact with two first crown facets 13 such that two adjacent first crown facets 13 share a common boundary 13*a* with a single star facet 12. There are sixteen (16) separate first crown facets 13. A boundary, as described herein, can include a point or edge, wherein the edge can be arcuate or linear. Boundaries of facets may or may not be symmetric. In a preferred embodiment, boundaries are substantially symmetric.

Crown 21 also includes a plurality of second crown facets 14 that generally extend around and space apart from the perimeter of facet table 11 and include a total of sixteen separate second crown facets 14. As shown in FIG. 1, each second crown facets 14 shares a common boundary point 14*a* with adjacent second crown facets 14. Each second crown facets 14 further shares a common boundary 14*b* with a single adjacent first crown facets 13.

Crown 21 includes a plurality of first upper half facets 15. The plurality of upper half cut facets 15 generally extend around the perimeter and space apart from of facet table 11, and upper half facets 15 include a total of sixteen separate facets. As shown in FIG. 1, each upper half facet 15 shares a common boundary 15*a* with two adjacent second crown facets 14.

FIG. 2 is a bottom view of gemstone 10, showing pavilion 23. As shown in FIG. 2, pavilion 23 includes various facets 16, 17, 18, 19 arranged in a generally symmetrical substantially circular pattern on pavilion 23. A plurality of first lower half cut facets 16 have at least one boundary side 16*a* in common with adjacent first lower half cut facets 16 and one boundary 16*c* in common with lower border 22*b* of girdle 22*a*. Lower border 22*b* of girdle 22*c* defines the upper perimeter of pavilion 23 and the upper border 22*a* of girdle 22*c* defines the lower perimeter of crown 21. The plurality of second crown facets 14 are arranged to extend generally around the circumference of the uppermost part of crown 21, and includes a total of sixteen separate second crown facets 14. As shown in FIG. 2, each first lower half cut facets 16 is in contact with an adjacent first lower half cut facets 16 such that two adjacent first lower half cut facets 16 share a common boundary being side 16*a*. There are thirty two separate first lower half cut facets 16. A common boundary can include an edge, adjacent side boundary, or a point boundary. As seen in FIG. 2, two adjacent first lower half cut facets 16 share a common boundary point 16*b* opposite shared common boundary 16*a*.

Pavilion 23 includes a plurality of first pavilion main cut facets 17. As seen in FIG. 2, and discussed above, said plurality of first pavilion main cut facets 17 have a kite geometric configuration. Said plurality of first pavilion main cut facets 17 are arranged to extend generally around the perimeter of pavilion 23, with long sides 17*b* being arranged in a radial relationship with culet 20. Pavilion 23 includes sixteen first pavilion main cut facets 17. As shown in FIG. 2, each first pavilion main cut facet 17 shares a common boundary 17*a* with adjacent first lower half cut facets 16. There are sixteen first pavilion main cut facets 17. Additionally, as seen in FIG. 2, first pavilion main cut facets 17 share a common boundary 17*b* with adjacent second lower half cut facets 18.

Figure 4:
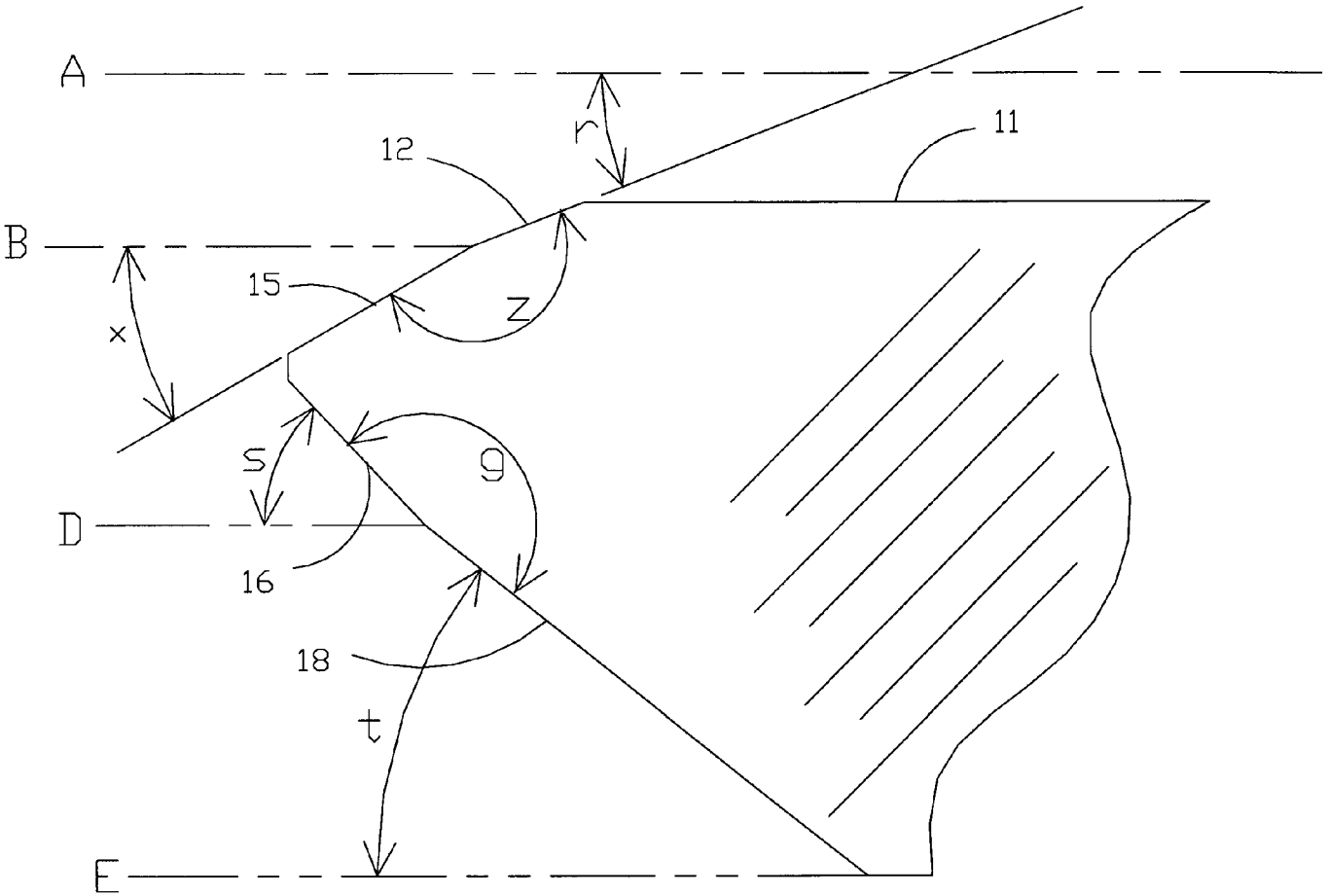
FIG. 4 is a partial side cut away along section line J-J from FIG. 1 showing angular orientation of facet cuts.
Figure 5:
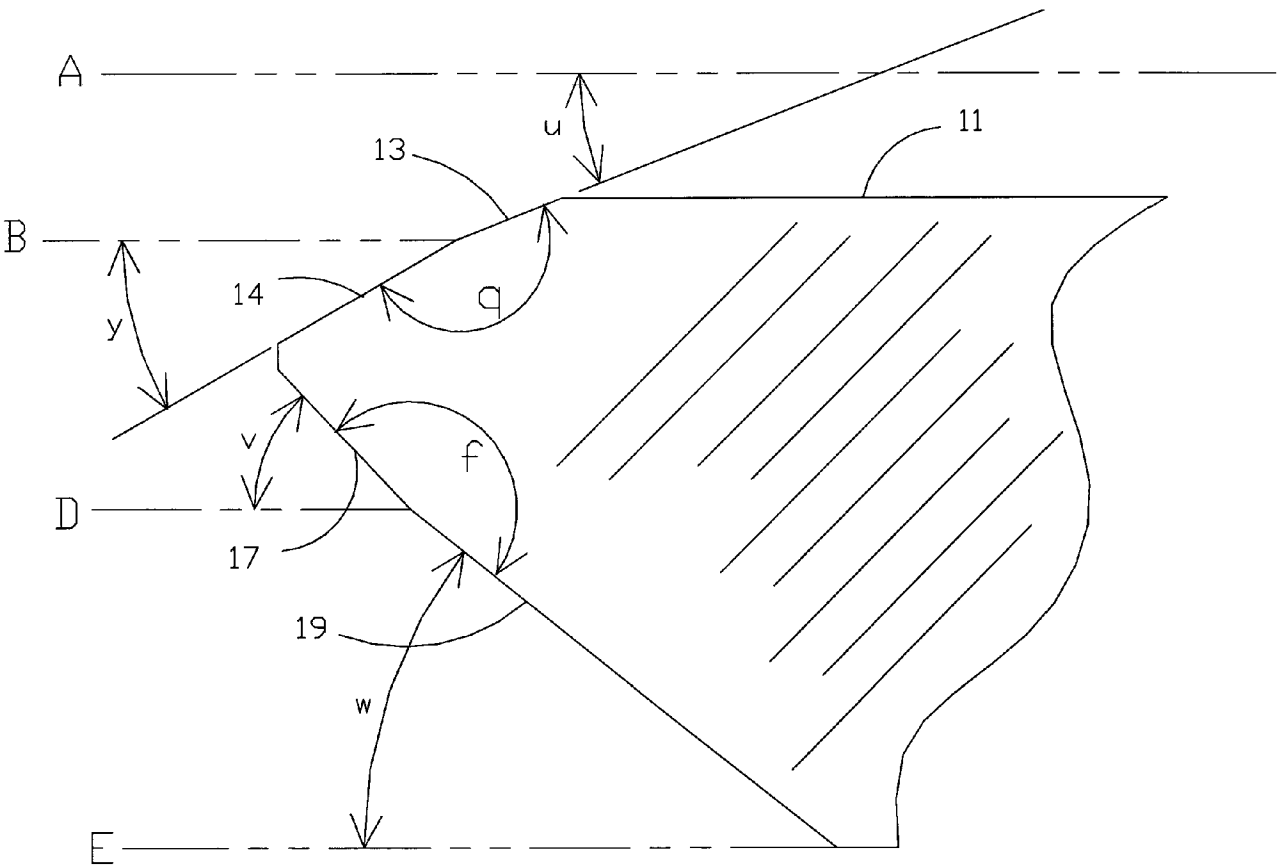
FIG. 5 is a partial side cut away along section line K-K from FIG. 1 with showing angular orientation of facet cuts

FIGS. 4 and 5 show a partial cut away of gemstone 10. FIG. 4 shows the angular orientation of facets 12, 15, 16, and 18. Reference lines A, B, D, and E are all parallel and represent horizontal planes with respect to gemstone 10. Reference lines A, B, D, and E are substantially parallel to table 11. Table 11 is substantially flat however depending on the cut of an individual gemstone 10, may have a slight pitch.

FIG. 5 is a partial side view along section line K-K from FIG. 1 The angular inflections shown in FIGS. 4 and 5 are depicted as demonstrative and not necessarily drawn to scale.

In a preferred embodiment, in FIG. 4, star facets 12 are formed at an angle r approximately of about 30-32° relative to the horizontal plane A of gemstone 10. Upper half facets 15 are formed at an angle x approximately of about 34-36° relative to the horizontal plane B of gemstone 10. Angle z is the angular inflection formed by the angular differential between the angle r of star facets 12 and the angle x of upper half facets 15. First lower half cut facets 16 are formed at an angle s approximately of about 30-32° relative to the horizontal plane D of gemstone 10. Second lower half cut facets 18 are formed at an angle t approximately of about 34-36° relative to the horizontal plane E of gemstone 10. Angle f is the angular inflection formed by the angular differential between the angle s of first lower half cut facets 16 and the angle t of second lower half cut facets 18.

In a preferred embodiment, in FIG. 5, first crown facets 13 are formed at an angle u approximately of about 34-36° relative to the horizontal plane A of gemstone 10. Second crown facets 14 are formed at an angle y approximately of about 40-41° relative to the horizontal plane B of gemstone 10. Angle q is the angular inflection formed by the angular differential between the angle u of first crown facets 13 and the angle y of second crown facets 14. First pavilion main cut facets 17 are formed at an angle v approximately of about 34-36° relative to the horizontal plane D of gemstone 10. Second pavilion main cut facets 19 are formed at an angle w approximately of about 40-41° relative to the horizontal plane E of gemstone 10. Angle f is the angular inflection formed by the angular differential between the angle v of first pavilion main cut facets 17 and the angle w of second pavilion main cut facets 19.

Pavilion 23 includes a plurality of second lower half cut facets 18. As seen in FIG. 2, and discussed above, each of said plurality of second lower half cut facets 18 have a triangular configuration. Each of said plurality of second lower half cut facets 18 are arranged to extend generally around the perimeter of pavilion 23 and are spaced radially from girdle 22*a*. Pavilion 23 includes thirty two second lower half cut facets 18. As shown in FIG. 2, second lower half cut facets 18 share a common boundary 18*a* with a single adjacent second lower half cut facets 18. As also seen in FIG. 2, each second lower half cut facets 18 shares a common point 18*b* with a single adjacent second lower half cut facet 18. There are thirty two (32) second lower half cut facets 18. Additionally, as seen in FIG. 2, each second lower half cut facets 18 shares a common boundary 17*b* with a single adjacent first pavilion main cut facets 17 and each second lower half cut facets 18 shares a common boundary 18*c* with a single adjacent second pavilion main cut facets 19.

Pavilion 23 includes a plurality of second pavilion main cut facets 19. As seen in FIG. 2, said second pavilion main cut facets 19 have a rhomboidal configuration. A rhombus, as discussed above, is a type of kite geometric configuration. The rhombus has four equal sides. Each of said plurality of second pavilion main cut facets 19 are arranged to extend around the perimeter of pavilion 23. Pavilion 23 further includes sixteen (16) second pavilion main cut facets 19 radially spaced around pavilion 23 adjacent to and touching facet 20. As shown in FIG. 2, each second pavilion main cut facets 19 shares a common boundary 19*a* with two adjacent second pavilion main cut facets 19. Boundary 19*a* being the shared boundary with two successive second pavilion main cut facets 19.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A gemstone consisting of:

a. a crown comprising a hexadecagon table disposed at the top of said crown, sixteen triangular star facets each defined by three connected edges, sixteen triangular first crown facets, each defined by three connected edges, sixteen triangular second crown facets each defined by three connected edges, and no more than sixteen triangular upper half facets, said star facets disposed around said hexadecagon table, said first crown facets disposed around and in-between said star facets with each star facet sharing an edge with each of two first crown facets, said second crown facets disposed adjacent to said first crown facets such that each second crown facet shares a single common boundary with a single first crown facet, with each second crown facet also disposed adjacent to and sharing an edge with each of two upper half facets, and said upper half facets disposed around and in-between said second crown facet;

b. a pavilion comprising thirty two circumferally arranged, triangular first lower half facets, sixteen circumferally arranged, kite shaped first pavilion main cut facets, the kite shaped first pavilion main cut facets positioned such that an elongated end of the kite shape extends away from the crown; each of said first lower half facets sharing one edge with an adjacent first pavilion main cut facet, thirty two second lower half cut facets arranged as pairs, wherein each pair shares the longest side of the triangular second lower half cut facet, and the remaining sides of each triangular second lower half cut facet are substantially the same length, and sixteen triangular second pavilion main cut facets that are each share two sides with two separate second lower half pavilion cut facets;

c. a girdle disposed between said crown and said pavilion; and d. a culet.

2. The gemstone of claim 1 wherein the gemstone is a diamond.

3. The gemstone of claim 1 wherein said first crown facet has an angle between about 34° to 36°.

4. The gemstone of claim 1 wherein said second crown facet has an angle between about 30° to 32°.

5. The gemstone of claim 1 wherein said first pavilion main cut facet has an angle between about 40.5° to 41.5°.

* * * * *